US009945018B2

(12) United States Patent
Krishnamurthy

(10) Patent No.: US 9,945,018 B2
(45) Date of Patent: Apr. 17, 2018

(54) ALUMINUM IRON BASED ALLOYS AND METHODS OF PRODUCING THE SAME

(71) Applicant: HONEYWELL INTERNATIONAL INC., Morristown, NJ (US)

(72) Inventor: Krish Krishnamurthy, Chandler, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 442 days.

(21) Appl. No.: 14/554,079

(22) Filed: Nov. 26, 2014

(65) Prior Publication Data

US 2016/0145727 A1 May 26, 2016

(51) Int. Cl.

| | |
|---|---|
| ***C22F 1/04*** | (2006.01) |
| ***C22F 1/00*** | (2006.01) |
| ***C22C 21/00*** | (2006.01) |

(52) U.S. Cl.

CPC ..... *C22F 1/002* (2013.01); *C22C 21/00* (2013.01); *C22F 1/04* (2013.01)

(58) Field of Classification Search

CPC ..... C22F 1/002; C22F 1/04; C22C 21/00
See application file for complete search history.

(56) References Cited

U.S. PATENT DOCUMENTS

| | | | | |
|---|---|---|---|---|
| 4,434,003 | A | 2/1984 | Geskin | |
| 4,460,541 | A | 7/1984 | Singleton et al. | |
| 4,624,705 | A | 11/1986 | Jatkar et al. | |
| 4,676,830 | A | 6/1987 | Inumaru et al. | |
| 4,702,885 | A * | 10/1987 | Odani | C22C 21/04 419/23 |
| 5,039,476 | A * | 8/1991 | Adachi | B22F 9/04 241/5 |
| 6,602,314 | B1 | 8/2003 | Sakaguchi et al. | |
| 7,875,132 | B2 | 1/2011 | Pandey | |
| 8,323,428 | B2 | 12/2012 | Chipko et al. | |
| 8,409,496 | B2 | 4/2013 | Pandey | |
| 8,409,497 | B2 | 4/2013 | Pandey | |
| 2003/0185701 | A1 | 10/2003 | Sahoo et al. | |
| 2004/0140019 | A1 | 7/2004 | Bampton et al. | |
| 2010/0077825 | A1* | 4/2010 | Chipko | B22F 3/17 72/256 |
| 2011/0064599 | A1 | 3/2011 | Pandey | |
| 2011/0091346 | A1 | 4/2011 | Pandey | |
| 2013/0143070 | A1 | 6/2013 | Palm | |

* cited by examiner

*Primary Examiner* — Lois L Zheng
(74) *Attorney, Agent, or Firm* — Lorenz & Kopf, LLP

(57) ABSTRACT

Aluminum iron based alloys and methods for producing the same are provided. In an exemplary embodiment, a method for producing an aluminum iron based alloy includes melting an aluminum iron based alloy to form a melt. The aluminum iron based alloy includes iron at about 2.0 to about 7.5 weight percent, silicon at about 0.5 to about 3.0 weight percent, aluminum at about 86 to about 97.5 weight percent, and one or more of manganese, vanadium, chromium, molybdenum, tungsten, niobium, zirconium, cerium, erbium, magnesium, calcium, scandium, ytterbium, yttrium, or tantalum at about 0.05 to about 3.5 weight percent. The melt is solidified at about $10^5$ degrees centigrade per second of faster to form particulates. The particulates are degassed at a degassing temperature of about 400 to about 500 degrees centigrade.

19 Claims, 1 Drawing Sheet

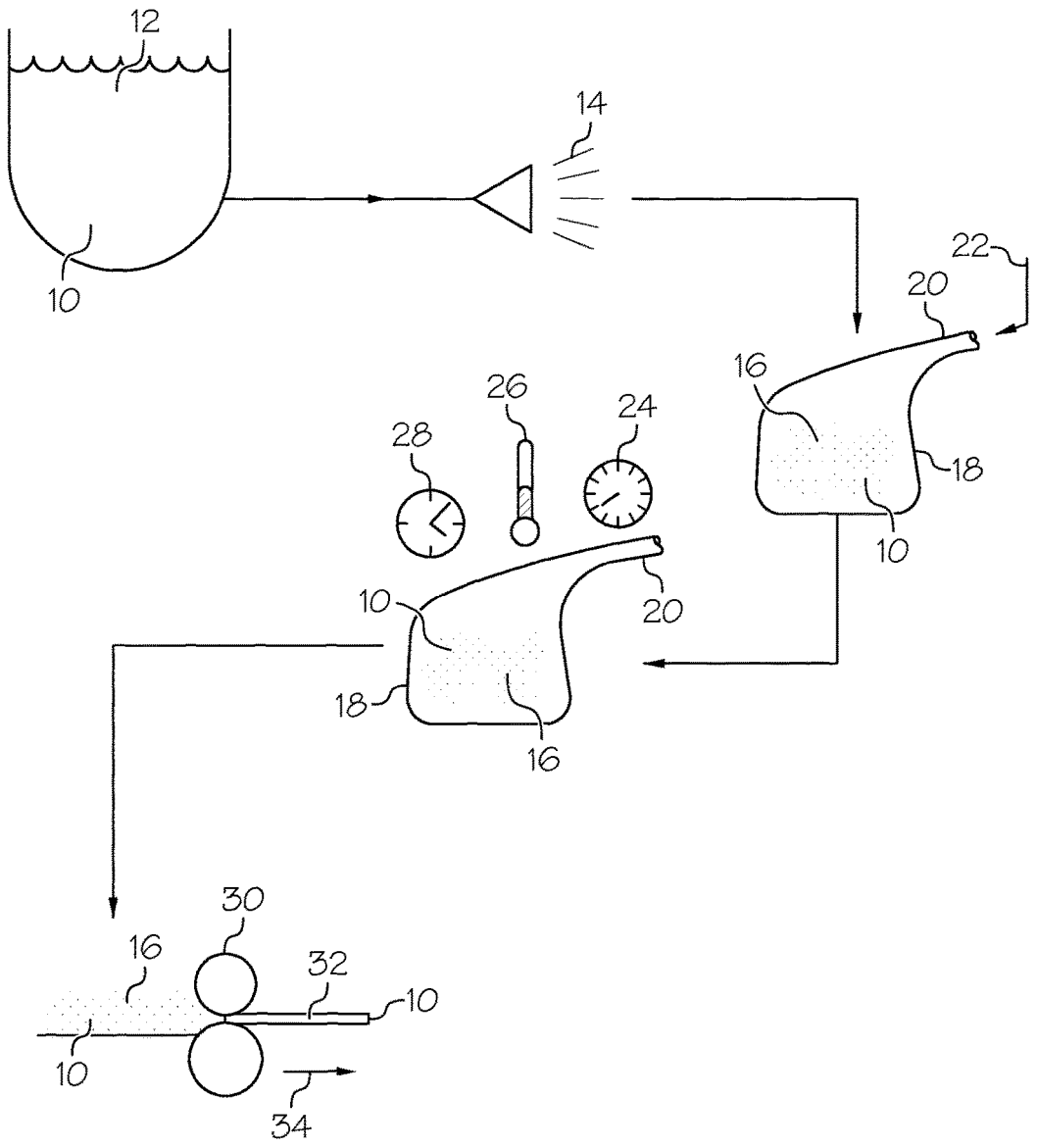
12
14
10
22
20
16
18
10
26
24
28
10
20
18
16
30
16
32
10
10
34

ALUMINUM IRON BASED ALLOYS AND METHODS OF PRODUCING THE SAME

TECHNICAL FIELD

The present disclosure generally relates to dispersion strengthened aluminum iron based alloys and methods of producing the same. More particularly, the disclosure relates to rapidly solidified aluminum iron based alloys with low aluminum oxide content, and methods of producing the same.

BACKGROUND

Aluminum iron based alloys can have mechanical properties comparable to some titanium alloys at elevated temperatures, such as temperatures of about 350 degrees centigrade (° C.). In particular, rapidly solidified (RS) aluminum iron based alloys have desirable properties. The RS aluminum iron based alloys are lighter than the titanium alloys, so they can provide comparable performance with less weight. However, the fabrication process for the aluminum iron based alloys is complex, and this has limited commercial use and exploitation of the beneficial properties.

The microstructure of aluminum iron based alloys impacts the properties of the alloy, and the microstructure depends on the manufacturing process. The microstructure can include dispersoids that are important to the properties of RS aluminum iron based alloys, and these dispersoids are undesirably coarsened if the alloys are processed at temperatures above about 500° C. or 550° C. The coarsening reduces the alloy strength and creep resistance. The coarsened dispersoids can be solutionized in the solid state, but they can't be re-precipitated in the form of very fine sized particles that are desirable, without re-melting and beginning the rapid solidification process again. Furthermore, processing at temperatures approaching or above about 500° C. can result in the precipitation of equilibrium intermetallic compounds leading to alloy embrittlement.

RS aluminum iron based alloys have been formed by melting, followed by rapid solidification and particulates formation, degassing, and finally by compaction. Absorbed water, hydrates, and/or hydroxides are present in the solidified particulates, and these water species, hydrates, or hydroxides gradually produce aluminum oxide so higher moisture, hydrate, or hydroxide concentrations increase the aluminum oxide concentration in the comminuted ribbon, flake, or powder particulates. Aluminum oxide in the form of film or stringers decreases the ductility and toughness, and also increases the brittleness of the final product. Aluminum oxide also undesirably increases the directionality of properties if the alloy is extruded.

Accordingly, it is desirable to provide aluminum iron based alloys and methods of producing the same with reduced moisture contents, lower concentrations of hydrates and/or hydroxides, and therefore lower concentrations of aluminum oxide. In addition, it is desirable to provide aluminum iron based alloys and methods of producing the same with higher ductility, lower brittleness, and lower directionality of properties than in traditional aluminum iron based alloys. Furthermore, other desirable features and characteristics of the present embodiment will become apparent from the subsequent detailed description and the appended claims, taken in conjunction with the accompanying drawings and this background of the invention.

BRIEF SUMMARY

Aluminum iron based alloys and methods for forming aluminum iron based alloys are provided. In an exemplary embodiment, a method of producing an aluminum iron based alloy includes melting an aluminum iron based alloy to form a melt. The aluminum iron based alloy includes iron at about 2.0 to about 7.5 weight percent, silicon at about 0.5 to about 3.0 weight percent, aluminum at about 86 to about 97.5 weight percent, and one or more of manganese, vanadium, chromium, molybdenum, tungsten, niobium, zirconium, cerium, erbium, magnesium, calcium, scandium, ytterbium, yttrium, or tantalum at about 0.05 to about 3.5 weight percent. The melt is solidified at about $10^5$ degrees centigrade per second of faster to form particulates. The particulates are degassed at a degassing temperature of about 400 to about 500 degrees centigrade.

A method for forming aluminum iron based alloys is provided in another embodiment. The method includes melting an aluminum iron based alloy to form a melt. The aluminum iron based alloy includes iron at about 2.0 to about 7.5 weight percent, silicon at about 0.5 to about 3.0 weight percent, aluminum at about 86 to about 97.5 weight percent, and one or more of manganese, vanadium, chromium, molybdenum, tungsten, niobium, zirconium, cerium, erbium, magnesium, calcium, scandium, ytterbium, yttrium, or tantalum at about 0.05 to about 3.5 weight percent. The melt is solidified at about $10^5$ degrees centigrade per second of faster to form particulates. The particulates are degassed at a degassing pressure of about $10^{-3}$ Torr to about $10^{-6}$ Torr.

In yet another embodiment, a metal product is provided. The metal product includes aluminum (Al) at about 86 to about 97.5 weight percent, iron (Fe) at about 2.0 to about 7.5 weight percent, silicon (Si) at about 0.5 to about 3.0 weight percent, and a tertiary element at about 0.05 to about 3.5 weight percent. The tertiary element (X) is selected from manganese, vanadium, chromium, molybdenum, tungsten, niobium, zirconium, cerium, erbium, magnesium, calcium, scandium, ytterbium, yttrium, or tantalum, or a combination thereof. A dispersoid is distributed throughout the metal product at about 15 to 40 volume percent, where the dispersoid has the formula $Al_{12}(FeX)_3Si$ or $Al_{13}(FeX)_3Si$. The (Fe+X):Si ratio is from about 2.0:1 to about 5.0:1. The metal product has an extrusion axis, and a ratio of a tensile strength parallel to the extrusion axis to the tensile strength perpendicular to the extrusion axis is from about 0.9:1 to about 1:1.

BRIEF DESCRIPTION OF THE DRAWINGS

Various embodiments will hereinafter be described in conjunction with the FIGURE, which is a schematic diagram of an exemplary embodiment of an apparatus and method for producing metallic alloys.

DETAILED DESCRIPTION

The following detailed description is merely exemplary in nature and is not intended to limit the various embodiments or the application and uses of the invention. Furthermore, there is no intention to be bound by any expressed or implied theory presented in the preceding technical field, background, brief summary, or the following detailed description.

Referring to the FIGURE, a method for producing an aluminum iron based alloy 10 is provided in accordance with an exemplary embodiment. The method includes melting an aluminum iron based alloy (Al/Fe alloy) 10 to form a melt 12. Certain aluminum iron based alloys 10, such as Al/Fe alloy 10, are strengthened by dispersoids present in the metal. The dispersoids are formed when a melt 12 is rapidly cooled and solidified, and these Al/Fe alloys 10 are sometimes referred to as rapidly solidified (RS) alloys, as mentioned above. The Al/Fe alloys 10 are initially formed by combining the desired components in a molten state. Such Al/Fe alloys 10 are primarily formed with the formula $Al_{bal}Fe_aSi_bX_c$, wherein X is a tertiary element, and X is at least one element selected from the group consisting of manganese (Mn), vanadium (V), chromium (Cr), molybdenum (Mo), tungsten (W), niobium (Nb), zirconium (Zr), cerium (Ce), erbium (Er), magnesium (Mg), calcium (Ca), scandium (Sc), ytterbium (Yb), yttrium (Y) and tantalum (Ta); where "a" ranges from about 2.0 to about 7.5 weight %; "b" ranges from about 0.5 to about 3.0 weight %; "c" ranges from about 0.05 to about 3.5 weight % and the balance (bal) is aluminum plus incidental impurities, with the proviso that the ratio [Fe+X]:Si is within the range of from about 2.0:1 to about 5.0:1. As such, aluminum is present in the aluminum iron based alloy 10 at about 86 to about 97.5 weight percent. Incidental impurities may be present up to about 0.1 weight percent. In some embodiments, X includes V and may include other elements as listed above for X, so V may be present at about 0.05 to about 3.5 weight percent.

To obtain the desired combination of strength and toughness the aluminum iron based alloys described herein are rapidly solidified to form a quench 14 from the melt 12 at cooling rates sufficient to produce a fine microstructure and intermetallic dispersoid. The quench rate from the molten state is in the range of, for example, about $10^{5\circ}$ C./second (sec) or faster, or about $10^{7\circ}$ C./sec or faster in an alternate embodiment. The rapid cooling rate can be achieved by various quenching techniques such as melt spinning, splat cooling, planar flow casting, or other similar methods. Quenching techniques such as melt spinning or planar flow casting produce a quench 14 having the form of a thin ribbon, flake, wire, or powder. The ribbon or wire may be further comminuted to a flake or particulate form, and the flake, particulate or powder forms are referred to herein as "particulates", where the term "particulates" includes flake, powder, or other forms with small particulates. The particulates 16 may also form into partially dense compacts of particulates in some embodiments, and the term "particulates" also includes partially dense compacts of particulates. The particulates 16 can be readily formed using a comminution device (not illustrated) such as a pulverizer, knife mill, rotating hammer mill or the like. Preferably, the comminuted particles form the particulates 16 with a particle size ranging from about −35 mesh to about +200 mesh, US standard sieve size.

The rapid quenching process produces dispersoids within the resulting quench 14, and these dispersoids are retained in the particulates 16. The dispersoids are part of a microstructure of the particulates 16, and the performance and physical properties of the final product depend on the microstructure. The dispersoids may be a fine, nearly spherical $Al_{12}(FeX)_3Si$ or $Al_{13}(FeX)_3Si$ phase formed by decomposition of the rapidly solidified aluminum alloy. "Nearly spherical" means that the dispersoids are closer in shape to spheres than to rods. That is, the dispersoids are rounded more so than elongated. This silicide dispersoid may make up from about 5 to about 45 volume % of the Al/Fe alloy 10 in some embodiments, or from about 15 to about 40 volume % in other embodiments. This gives a range of Al/Fe alloy 10 compositions all having a [Fe+X]:Si ratio within the above mentioned range of from about 2:1 to about 5:1. In some embodiments, most of the dispersoids (more than 50 weight percent) are $Al_{12}(FeV)_3Si$ or $Al_{13}(FeV)_3Si$, where the general element "X" is vanadium.

Once the melt 12 is solidified, the resulting Al/Fe alloy 10 should be maintained at or below a coarsening temperature, where the coarsening temperature may be about 500° C. in some embodiments, or about 550° C. in other embodiments. If the Al/Fe alloy 10 is heated above the coarsening temperature, the microstructure begins to degrade and coarsen. As the microstructure coarsens, the metal becomes more embrittled, losses strength, and becomes less malleable, all of which are undesirable traits. Also, undesirable precipitates may begin to form if the Al/Fe alloy 10 is heated above the coarsening temperature.

In some embodiments, the particulates 16 are purged for drying and purification, where the particulates 16 may include partially dense compacts of particulates, as described above. The particulates 16 may be placed in a can 18 having a spout 20 for the purge step, but other techniques can also be used. Purging, if used, includes evacuating gases from the particulates 16, such as from the can 18, and then pressurizing the particulates 16 with an inert gas 22, such as nitrogen, argon or other inert gases. In an exemplary embodiment, the particulates 16 may be purged by evacuating gases to a pressure of about $10^{-3}$ torr to about $10^{-6}$ torr, and then adding inert gas 22 to a pressure of about 100 torr to about 10,000 torr. However, other pressures may be used in alternate embodiments, and the pressures used are not critical to the purging process. The particulates 16 may be evacuated of gases for about 1 sec to about 24 hours, or for about 1 minute (min.) to about 60 min. in an alternate embodiment. The particulates 16 may be exposed to the inert gas 22 for about 1 sec. to about 24 hours, or for about 1 min. to about 60 min. in different embodiments, but other time periods for the gas evacuation and exposure to inert gas 22 may also be used as the time periods are not critical to the purging process. The particulates 16 may at a temperature of about −40 to about 500° C. during the purging process, or at a temperature of about 20 to about 200° C. in an alternate embodiment, but other temperatures can also be used and the temperature is not critical to the purging process. The particulates 16 may be purged from 1 to 100 times, or from 1 to 20 times, or from 10 to 100 times, or from 50 to 100 times in various embodiments.

Water, aluminum hydrates, and/or hydroxides are typically present in the particulates 16 after they are formed, and these compounds gradually convert to aluminum oxide as time passes. The aluminum oxide makes the product less ductile, more brittle, and also produces directionality of properties if the Al/Fe alloy 10 is extruded. The presence of aluminum oxide stringers or films at prior particle boundaries generally leads to lower toughness and may affect fatigue resistance. In the case of extruded alloy, if the aluminum oxide film is not broken up effectively due to inadequate extrusion processing conditions, the transverse properties, especially transverse ductility, will be severely degraded. While the tensile elongation values in the longitudinal direction (parallel to extrusion axis) are not noticeably affected and can remain high, the elongation values in the transverse direction (perpendicular to extrusion axis) may be severely degraded. As an example, an extruded alloy can have elongation of 10 to 15% in the longitudinal direction while exhibiting only 1% elongation in the transverse direction. The elongation in other off-axis orientations is also lower than in the longitudinal direction. This directionality of properties persists even after forging of the extruded alloy. One approach to counter this directionality issue is to increase the extrusion ratios, as discussed below.

Aluminum hydrates are water insoluble compounds that do not readily dissociate. Accordingly, after the purging process the particulates 16 are subjected to a degassing process. The particulates 16 are degassed at elevated temperatures and low pressures to dissociate the aluminum hydrates to form hydroxides, and the resulting hydroxides can then be removed from the particulates 16. The degassing process also removes water, other hydrates, or hydroxides that may be present in the particulates 16, as well as other compounds that can produce aluminum oxide. The degassing process includes evacuating gases from the particulates 16, such as from within the can 18, to a degassing pressure 24 while heating the particulates 16 to a degassing temperature 26 for a degassing time period 28.

In an exemplary embodiment, the particulates 16 are degassed at a degassing temperature 26 of about 400 to about 550° C. In alternate embodiments, the particulates 16 are degassed at a degassing temperature 26 of about 400 to about 500° C., or about 450 to about 500° C., or about 470 to about 500° C., or about 450 to about 550° C., or about 490 to about 550° C. The degassing temperature 26 may be maintained during the entire degassing time period 28, or the degassing temperature 26 may be ramped up or down during the degassing time period 28. For example, the degassing temperature 26 may be ramped from an initial degassing temperature 26 of about 400° C. to a final degassing temperature 26 of about 500° C., but a wide variety of temperature ramps can be used in alternate embodiments. Testing indicates that degassing at a degassing temperature 26 less than about 400° C. and a degassing pressure 24 of about $10^{-3}$ torr does not remove all the aluminum hydrates, and higher degassing temperatures 26 increase the amount of aluminum hydrate removed from the particulates 16. However, degassing at degassing temperatures 26 that approach the coarsening temperature risks coarsening of the dispersoids and/or precipitation of embrittling compounds.

The particulates 16 are degassed at a degassing pressure 24, and the degassing pressure 24 is about $10^{-3}$ to about $10^{-6}$ torr in an exemplary embodiment. In alternate embodiments, the degassing pressure 24 is about 10 to about $10^{-6}$ torr, or about $10^{-5}$ to about $10^{-6}$ torr. The degassing pressure 24 can be reduced by connecting a vacuum system to the spout 20 in embodiments where the particulates 16 are in a can 18. The vacuum system (not illustrated) may include a mechanical vacuum pump capable of reducing the pressure to about 10 torr, and this may be coupled with a diffusion vacuum pump in some embodiments to decrease the pressure to about $10^{-6}$ torr. However, other vacuum systems may be used in alternate embodiments. The lower pressures accelerate the rate of dissociation of the aluminum hydrates (or other hydrates) to form hydroxides, and thereby further aid in removal of hydroxides formed from the hydrates.

The degassing process for the particulates 16 extends for a degassing time period 28, where the degassing time period 28 is measured from when temperature is within the range of the degassing temperature 26 and pressure is within the range of the degassing pressure 24. The degassing time period 28 extends until the time when the particulates 16 are no longer within the range of the degassing temperature 26 and/or the degassing pressure 24. The degassing time period 28 may extend from about 4 hours to about 7 days in some embodiments, but in other embodiments the degassing time period 28 is about 12 hours to about 7 days, or about 1 day to about 7 days, or about 2 days to about 7 days, or about 4 days to about 7 days in various embodiments. Aluminum hydrate and other hydrates will convert to aluminum and hydroxides, and gaseous species such as water vapor and hydrogen, but the conversion proceeds at a rate that depends on the temperature, pressure, and other factors. The conversion rate may be relatively slow, so an extended degassing time period 28 may increase the amount of hydrates removed from the particulates 16. As such, a degassing time period 28 measured in hours or days provides benefits over a shorter degassing time period 28. However, after some time the benefit of extending the degassing time period 28 is minimal, such as after about 7 days. The various degassing time periods 28, degassing temperatures 26, and degassing pressures 24 described above may be combined in almost any manner to provide a degassing process that effectively reduces the hydrates in the particulates 16.

Next, the particulates 16 are compacted in a compactor 30 to produce a metal product 32. The metal product 32 may be further processed after compaction, such as with extrusion, machining, welding, etc. The compactor 30 may be an extruder, a roller, a forge, a hammer press, an impact press, or other devices in various embodiments. Compactors that break down any remaining oxide layer on the particles of the particulates 16 may improve the ductility and toughness of the metal product 32, and reduce the directionality of properties, such as an extruder with an extrusion ratio of about 4:1 to about 10:1, or even up to about 20:1 or higher. Extrusion temperatures of about 475° C. or less help to prevent deterioration and coarsening of the microstructure, and maintain the strength, ductility, and brittleness of the metal product 32 within desired ranges.

The metal product 32 produced may have an extrusion axis 34, and the tensile strength can be measured parallel to the extrusion axis 34 and perpendicular to the extrusion axis 34. In an exemplary embodiment, the ratio of the metal product's tensile strength parallel to the extrusion axis to the metal product's tensile strength perpendicular to the extrusion axis 34 is in the range of about 0.8:1 to 1:1, or about 0.9:1 to 1:1, or about 0.95:1 to 1:1 in various embodiments. The degassing process removes many of the hydrates that form aluminum oxide, and this produces a metal product 32 with little difference in the tensile strength measured parallel and perpendicular to the extrusion axis 34. The metal product 32 can be machined, welded, or otherwise processed as desired. In some embodiments, the metal product 32 is welded using low temperature welding processes, or welding processes that limit the volume and time period of increased temperature, such as friction welding or laser welding.

The metal product 32 can be used for a wide variety of uses, and may replace titanium in some embodiments. The metal product 32 may retain the microstructure, including the dispersoids, and metal product 32 may retain the strength, reduced creep, and other properties associated with the microstructure, even when used at elevated operating temperatures, such as temperatures up to about 450° C. As such, the metal product 32 may be used in many applications with higher temperatures, such as aerospace, propulsion, hydraulics, or various combustion-related processes.

While at least one embodiment has been presented in the foregoing detailed description of the invention, it should be appreciated that a vast number of variations exist. It should also be appreciated that the embodiment or embodiments are only examples, and are not intended to limit the scope, applicability, or configuration of the invention in any way. Rather, the foregoing detailed description will provide those skilled in the art with a convenient road map for implementing an embodiment of the invention, it being understood that various changes may be made in the function and arrangement of elements described without departing from the scope as set forth in the appended claims and their legal equivalents.

The invention claimed is:

1. A method of producing an aluminum iron based alloy, the method comprising the steps of:

melting the aluminum iron based alloy to form a melt, wherein the aluminum iron based alloy comprises iron at about 2.0 to about 7.5 weight percent, silicon at about 0.5 to about 3.0 weight percent, aluminum at about 86 to about 97.5 weight percent, and one or more of manganese, vanadium, chromium, molybdenum, tungsten, niobium, zirconium, cerium, erbium, magnesium, calcium, scandium, ytterbium, yttrium, or tantalum at about 0.05 to about 3.5 weight percent;

solidifying the melt to form particulates, wherein the melt is solidified at about $10^5$ degrees centigrade per second or faster; and degassing the particulates at a degassing temperature of about 450 to about 550 degrees centigrade.

2. The method of claim 1 wherein degassing the particulates comprises degassing the particulates for a degassing time period of about 4 hours to about 7 days.

3. The method of claim 1 wherein degassing the particulates comprises degassing the particulates for a degassing time period of about 12 hours to about 7 days.

4. The method of claim 1 wherein degassing the particulates comprises degassing the particulates at the degassing temperature, wherein the degassing temperature is from about 490 to about 550 degrees centigrade.

5. The method of claim 1 wherein degassing the particulates comprises degassing the particulates at the degassing temperature, wherein the degassing temperature is about 450 to about 500 centigrade.

6. The method of claim 1 wherein degassing the particulates comprises degassing the particulates at the degassing temperature, wherein the degassing temperature is about 470 to about 500 degrees centigrade.

7. The method of claim 1 wherein degassing the particulates comprises degassing the particulates at a degassing pressure of about $10^{-3}$ to about $10^{-6}$ torr.

8. The method of claim 1 wherein degassing the particulates comprises degassing the particulates at a degassing pressure of about $10^{-4}$ to about $10^{-6}$ torr.

9. The method of claim 1 wherein degassing the particulates comprises degassing the particulates at a degassing pressure of about $10^{-5}$ to about $10^{-6}$ torr.

10. The method of claim 1 wherein solidifying the melt comprises forming a quench and forming the quench into the particulates.

11. The method of claim 1 further comprising compacting the particulates into a metal product.

12. The method of claim 11 wherein compacting the particulates into the metal product comprises compacting the particulates into the metal product wherein the metal product has an extrusion axis, and wherein a ratio of a tensile strength parallel to the extrusion axis to the tensile strength perpendicular to the extrusion axis is about 0.9:1 to about 1:1.

13. The method of claim 1 wherein melting the aluminum iron based alloy comprises melting the aluminum iron based alloy wherein the aluminum iron based alloy comprises vanadium at about 0.05 to about 3.5 weight percent.

14. A method of producing an aluminum iron based alloy, the method comprising the steps of:

melting an aluminum iron based alloy to form a melt, wherein the aluminum iron based alloy comprises aluminum at about 86 to about 97.5 weight percent, iron at about 2.0 to about 7.5 weight percent, silicon at about 0.5 to about 3.0 weight percent, and one or more manganese, vanadium, chromium, molybdenum, tungsten, niobium, zirconium, cerium, erbium, magnesium, calcium, scandium, ytterbium, yttrium, or tantalum at about 0.05 to about 3.5 weight percent;

solidifying the melt to form particulates, wherein the melt is solidified at about $10^5$ degrees centigrade per second or faster; and degassing the particulates at a degassing pressure of about $10^{-3}$ Torr to about $10^{-6}$ Torr and a degassing temperature of from about 450 to about 550 degrees centigrade.

15. The method of claim 14 wherein degassing the particulates comprises degassing the particulates at the degassing pressure, wherein the degassing pressure is about $10^{-4}$ torr to about $10^{-6}$ torr.

16. The method of claim 14 wherein degassing the particulates comprises degassing the particulates at the degassing pressure, wherein the degassing pressure is about $10^{-5}$ to about $10^{-6}$ torr.

17. The method of claim 14 wherein degassing the particulates comprises degassing the particulates for a degassing time period, wherein the degassing time period is about 12 hours to about 7 days.

18. The method of claim 14 wherein degassing the particulates comprises degassing the particulates at the degassing temperature, wherein the degassing temperature is about 450 to about 500 degrees centigrade.

19. The method of claim 14 wherein degassing the particulates comprises degassing the particulates at the degassing temperature, wherein the degassing temperature is about 490 to about 550 degrees centigrade.

* * * * *